US006154624A

United States Patent [19]

Sasaki et al.

[11] Patent Number: 6,154,624

[45] Date of Patent: Nov. 28, 2000

[54] IMAGE FORMING APPARATUS USING A DEVELOPING LIQUID

[75] Inventors: Tsutomu Sasaki, Kanagawa; Masahiko Itaya, Tokyo, both of Japan

[73] Assignee: Ricoh Company, Ltd., Tokyo, Japan

[21] Appl. No.: 09/392,718

[22] Filed: Sep. 9, 1999

[30] Foreign Application Priority Data

| | | | |
|---|---|---|---|
| Sep. 9, 1998 | [JP] | Japan | 10-272530 |
| Sep. 10, 1998 | [JP] | Japan | 10-257270 |
| Sep. 10, 1998 | [JP] | Japan | 10-274330 |

[51] Int. Cl.[7] ..... G03G 15/10

[52] U.S. Cl. ..... 399/250; 204/571; 399/237

[58] Field of Search ..... 399/237, 238, 399/250, 359; 141/85; 204/554, 571; 210/767, 806, 805; 430/117, 125

[56] References Cited

U.S. PATENT DOCUMENTS

| | | | |
|---|---|---|---|
| Re. 34,437 | 11/1993 | Ariyama et al. | 399/225 |
| 5,036,365 | 7/1991 | Landa | 399/237 |
| 5,923,930 | 7/1999 | Tsukamoto et al. | 399/237 |
| 5,937,247 | 8/1999 | Takeuchi et al. | 399/237 |
| 5,942,095 | 8/1999 | Day et al. | 204/571 X |

FOREIGN PATENT DOCUMENTS

| | | |
|---|---|---|
| 5-11623 | 1/1993 | Japan . |
| 5-27657 | 2/1993 | Japan . |
| 6-90587 | 11/1994 | Japan . |

*Primary Examiner*—Sophia S. Chen
*Attorney, Agent, or Firm*—Oblon, Spivak, McClelland, Maier & Neustadt, P.C.

[57] ABSTRACT

In an image forming apparatus, a developing liquid collected from an image carrier and/or an intermediate transfer body is caused to migrate through a gap between two electrodes to each of which a particular electrode is applied. An electric field formed between the electrodes sequentially increases in strength in the direction of migration of the developing liquid, so that toner and other solids contained in the developing liquid are retained by electrodeposition. One or more foam blocks each having continuous cells absorb the collected liquid under the action of the electric field and thereby retain the solids therein. As a result, only a carrier liquid is recovered from the collected liquid and reused for development.

41 Claims, 15 Drawing Sheets

IMAGE FORMING APPARATUS USING A DEVELOPING LIQUID

BACKGROUND OF THE INVENTION

1. Field of the Invention

The present invention relates to a copier, facsimile apparatus, printer or similar image forming apparatus of the type developing a latent image electrostatically formed on an image carrier with a developer consisting of a liquid and toner dispersed therein, transferring the resulting toner image to a recording medium, and collecting the liquid left on at least one the image carrier and an intermediate transfer body after the image transfer to thereby effect cleaning. More particularly, the present invention relates to an image forming apparatus capable of separating the collected developing liquid into solids including the toner and a liquid and recovering only the liquid.

2. Discussion of the Background

It is a common practice with an image forming apparatus of the type described to simply discard a collected developing liquid because it contains toner which cannot be recovered. Particularly, in an image forming apparatus using developing liquids each containing toner of particular color, it is difficult to reuse the liquids because the collected liquid contains toner of different colors. Wasting the collected developing liquid is undesirable in consideration of limited resources.

Japanese Patent Laid-Open Publication Nos. 7-209922, 7-152254 and 7-239615, for example, propose to use a dense, viscous developing liquid having a relatively high toner content for the miniaturization of a developing device or to apply, before development using such a developing liquid, a prewetting liquid to an image carrier. The prewetting liquid is a chemically inactive, dielectric liquid having a parting ability. The problem discussed above is also given rise to when use is made of the dense, viscous developing liquid alone or in combination with the prewetting liquid.

Technologies relating to the present invention are also disclosed in, e.g., Japanese Patent Laid-Open Publication Nos. 5-11623 and 5-27657 and Japanese Patent Publication No. 6-90587.

SUMMARY OF THE INVENTION

It is therefore an object of the present invention to provide an image forming apparatus capable of recovering a liquid component from a developing liquid collected from at least one of an image carrier and an intermediate transfer body after image transfer, and reusing the collected liquid for development.

In accordance with the present invention, an image forming apparatus using a developing liquid consisting of a liquid and toner dispersed therein includes a developing unit for developing a latent image electrostatically formed on an image carrier by using the developing liquid to thereby form a corresponding toner image. A transferring section transfers the toner image from the image carrier to a recording medium. A cleaning unit collects the developing liquid left after image transfer for thereby effecting cleaning. A separating device includes at least two electrodes between which the developing liquid collected by the cleaning unit is passed. A particular potential is applied to each of the electrodes for forming an electric field sequentially increasing in strength in the direction of migration of the developing liquid. As a result, a charged solid component contained in the liquid is electrodeposited on either one of the electrodes to thereby recover a liquid component from the liquid.

Also, in accordance with the present invention, an image forming method for forming a toner image on an image carrier with a developing liquid consisting of a liquid and toner dispersed therein, transferring the toner image from the image carrier to a recording medium, and removing the developing liquid left on the surface of the image carrier after image transfer to thereby clean the surface includes the steps of collecting the developing liquid removed from the image carrier, causing the developing liquid collected to migrate through a member capable of controlling the spread of the developing liquid, causing an electric field to act on the developing liquid migrating through the member, and moving a solid component contained in the developing liquid to a preselected position and retaining it at the preselected position. As a result, a liquid component also contained in the developing liquid is recovered via the member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
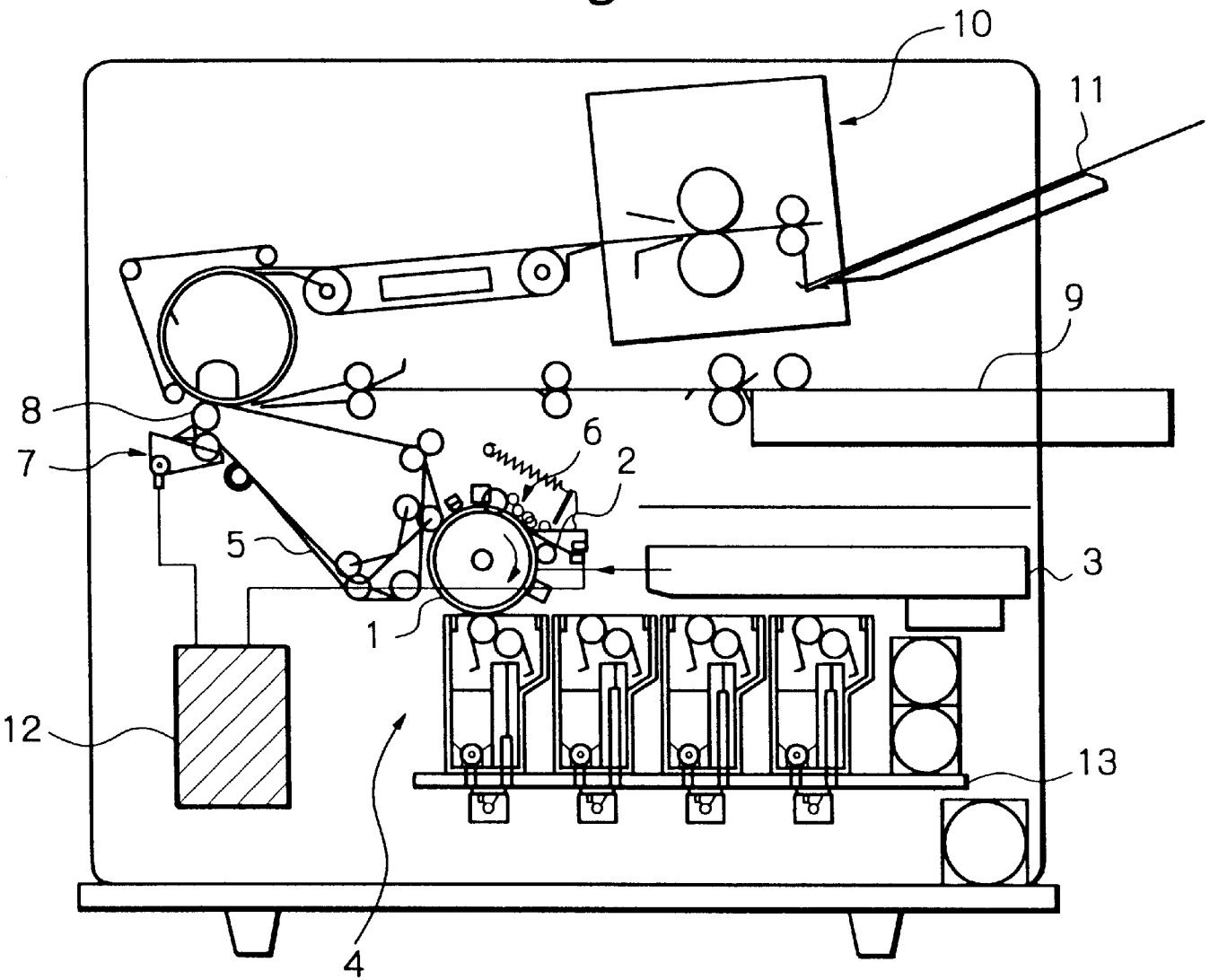
FIG. 1 is a view showing the general construction of an image forming apparatus in accordance with the present invention and using a developing liquid.

Preferred embodiments of the image forming apparatus in accordance with the present invention will be described hereinafter. In the illustrative embodiments to be described, the image forming apparatus is implemented as an electrophotographic copier by way of example. It is to be noted that the reference numerals used in the individual embodiment are particular to the embodiment and do not always designate identical structural elements when used in the other embodiments.

First Embodiment

Referring to FIG. 1 of the drawings, an electrostatic copier embodying the present invention includes a photoconductive drum or image carrier 1. Arranged around the drum are a charge roller 2, an optical writing unit 3, an intermediate transfer belt (transfer belt hereinafter) 5, and a drum cleaning unit 6 for cleaning the drum 1. Developing units 4 are mounted on a base 13 movable back and forth in the horizontal direction, as indicated by a double headed arrow. A transfer roller or transferring means 8 faces the transfer belt 5 for transferring a developed image to a paper or similar recording medium. The reference numeral 7 designates a belt cleaning unit 7 for cleaning the transfer belt 5.

A motor or similar drive means, not shown, causes the drum 1 to rotate at a constant speed in a direction indicated by an arrow in FIG. 1. While the drum 1 is in rotation, the charge roller 2 uniformly charges the surface of the drum 1 in the dark. The optical writing unit 3 focuses light representative of image data on the charged surface of the drum 1, thereby electrostatically forming a latent image on the drum 1. The above image data are produced by separating a desired full-color image into a yellow, a magenta, a cyan and a black component. When the base 13 is horizontally moved to bring any one of the developing units 4 into contact with the drum 1, the developing unit develops the latent image with yellow, magenta, cyan or black toner stored therein to thereby form a corresponding toner image.

A yellow, a magenta, a cyan and a black toner image sequentially formed on the drum 1 by the above procedure are sequentially transferred to the transfer belt 5 one above the other in this order. The transfer belt 5 is rotated at the same speed as the drum 1. The transfer roller 8 transfers the resulting composite toner image or full-color image from the transfer belt 5 to a paper fed from a paper cassette 9 to an image transfer station where the roller 8 is located.

After the image transfer, a fixing unit 10 fixes the composite toner image on the paper. Finally, the paper is driven out to a copy tray 11. The drum cleaning unit 6 removes a developing liquid left on the drum 1 in a small amount after the image transfer to the belt 5. Likewise, the belt cleaning unit 7 removes the developing liquid left on the belt 5 in a small amount after the image transfer to the paper. Subsequently, a discharge lamp, not shown, dissipates potentials remaining on the drum 1 for thereby preparing the drum 1 for the next image formation. The developing liquid removed by each of the cleaning units 6 and 7 is delivered to a carrier collecting device 12. In the illustrative embodiment, use is made of a developing liquid consisting of an insulating carrier and toner dispersed in the carrier and having a viscosity as high as 100 mPa.s to 10,000 mPa.s.

Figure 2:
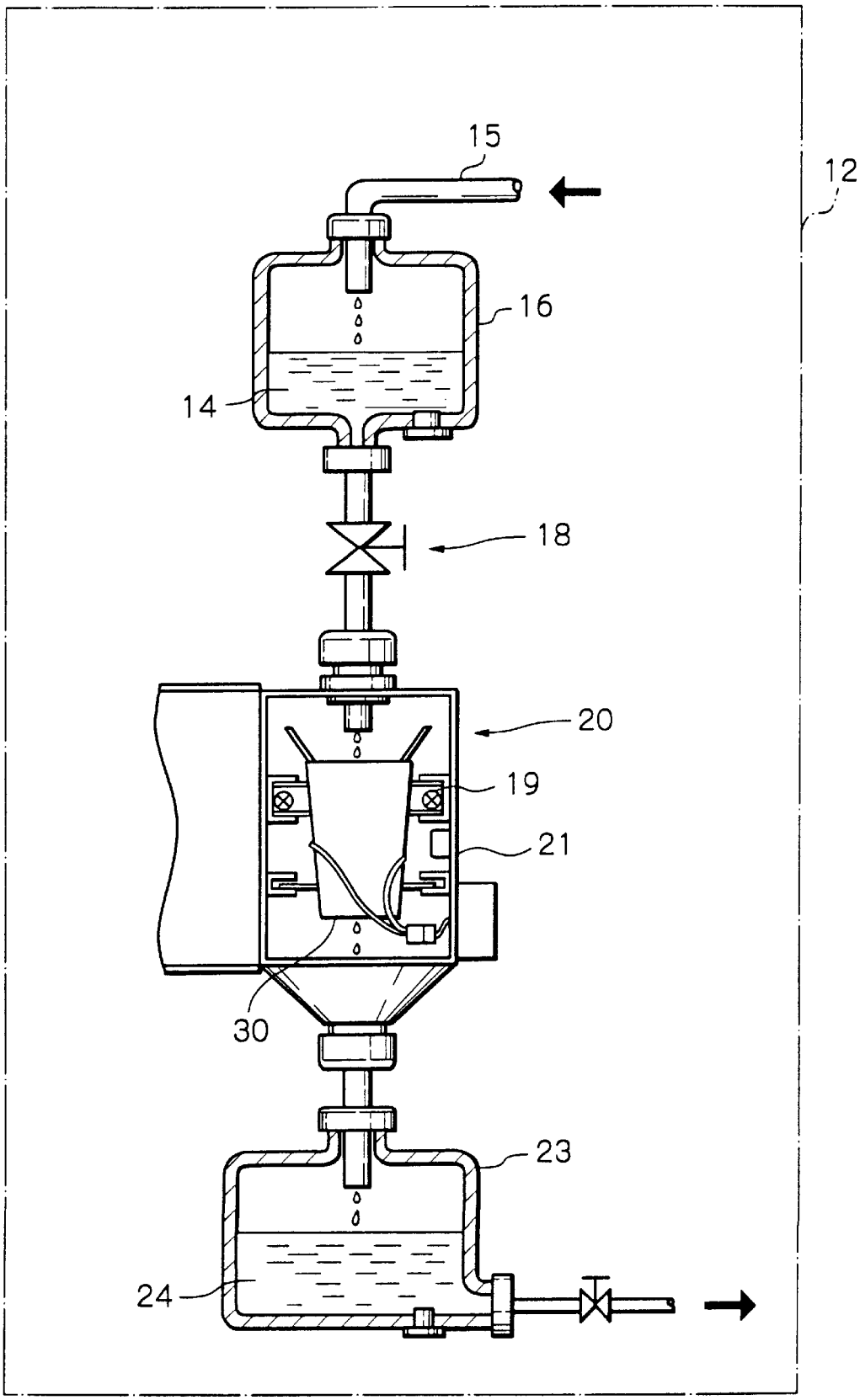
FIG. 2 is a view showing a carrier separating unit included in a first embodiment of the present invention.

FIG. 2 shows a specific configuration of the carrier collecting device 12. As shown, a collected developing liquid 14 containing toner of different colors and received from the cleaning units 6 and 7 is introduced into the carrier collecting device 12. The device 12 separates the developing liquid 14 into a carrier liquid 24 and solids including toner.

Specifically, the carrier collecting device 12 includes a liquid tank 16 communicated to the drum cleaning unit 6 and belt cleaning unit 7 by a piping 15. The developing liquid 14 collected by the cleaning units 6 and 7 is introduced into the liquid tank 16 via the piping 15. A flow control valve 18 feeds the liquid 14 from the liquid tank 16 to a carrier separating unit 20 at a preselected adequate rate. The carrier separating unit 20 includes a case 21 and a unit body 30 accommodated in the case 21. The unit body 30 separates the liquid 14 into the carrier liquid 24 and toner and other solids. The carrier liquid 24 separated from the collected liquid 14 falls into a carrier tank 23 in the form of drops by gravity and can be again used for development.

Figure 3:
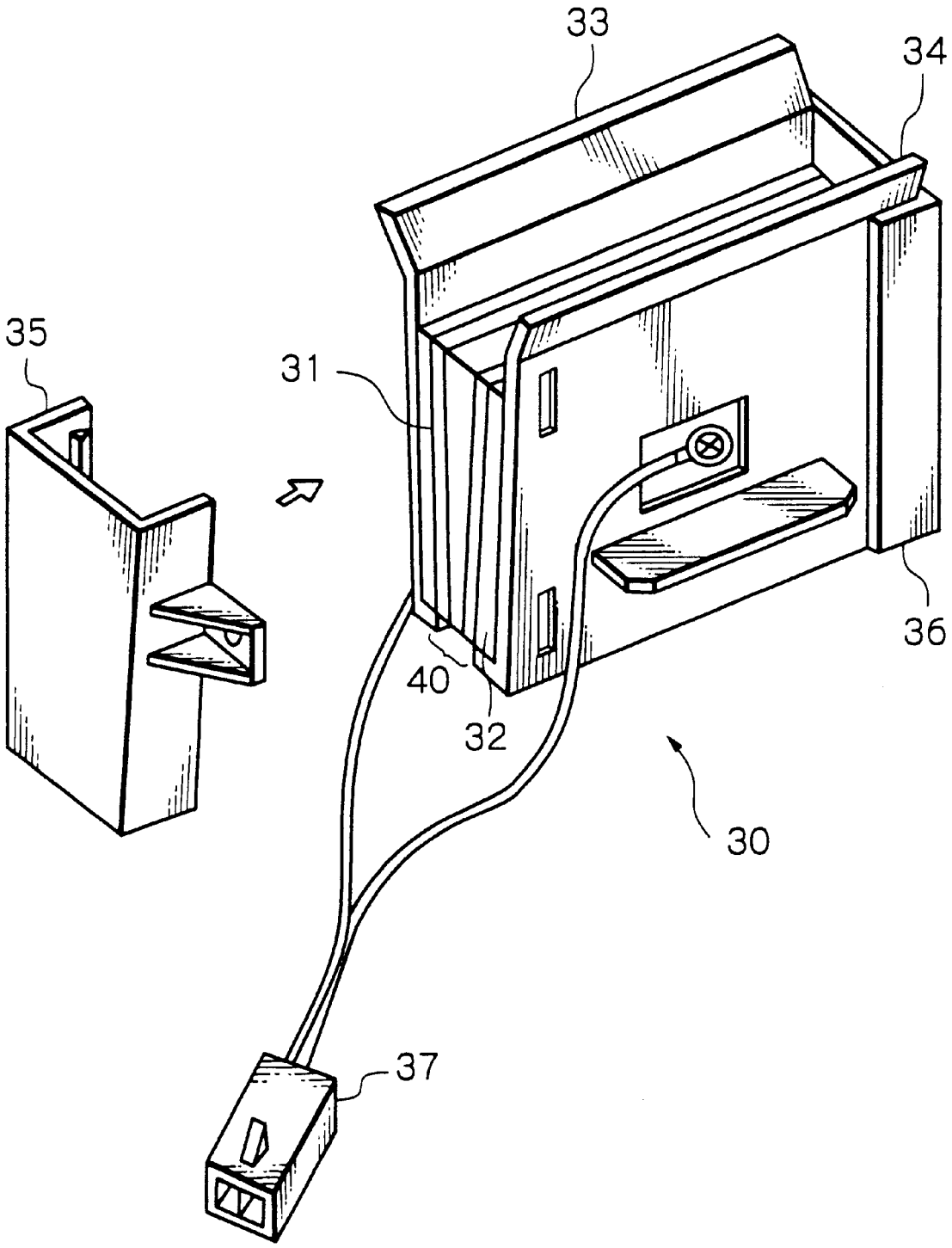
FIG. 3 is a view showing a unit body included in the carrier separating unit.

FIG. 3 shows the unit body 30 of the carrier separating unit 20 with a front panel 35 removed from the unit body 30. As shown, the unit body 30 is fastened to the inside of the case 21 by screws 19 (see FIG. 2) and is easily removable from the case 21. The unit body 30 includes a carrier separating portion 40, insulating plates 31 and 32, side panels 33 and 34 sandwiching them from opposite sides, a rear panel 36 and a connector 37 as well as the front panel 35.

Figure 4A:
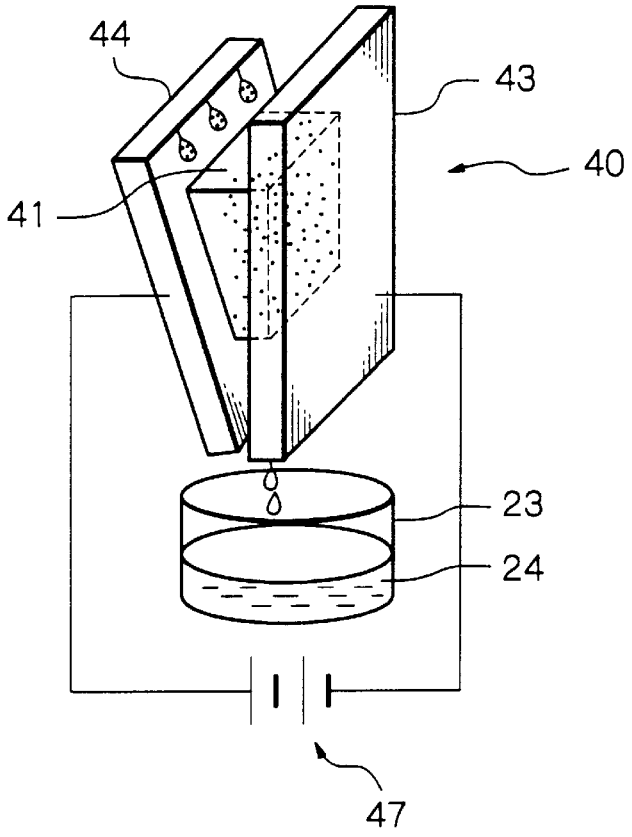
FIG. 4A is a view showing a carrier separating portion also included in the carrier separating unit.

The basic configuration of the carrier separating portion 40 is shown in FIG. 4A specifically. As shown, the portion 40 is generally made up of a foam block 41 having continuous cells and a pair of flat electrodes 43 and 44 sandwiching the foam block 41. A power supply 47 applies a voltage to the electrode 44, as will be described specifically later.

In the illustrative embodiment, the collected developing liquid 14 contains solids including toner having a mean particle size of 0.1 $\mu$m to 10 $\mu$m and charged to positive polarity. The toner is electrodeposited on the electrode 44, but not on the other electrode 43. The gap between the two electrodes 43 and 44 is selected to be 5 mm at the top to which the liquid 14 drops and selected to be 2 mm at the bottom where the separation ends. The electrodes 43 and 44 each are sized 100 mm in the lengthwise direction and 40 mm in the widthwise direction. The foam block 41 positioned between the electrodes 43 and 44 controls the spread of the collected liquid 14 and has a V-shaped configuration substantially complementary to the above gap. For the foam block 41, use is made of PVF (polyvinyl formal) having a cell diameter of about 700 $\mu$m. The power supply 47 applies a voltage to the electrode 44 located at the non-electrodeposition side. The electrode 43 is connected to ground.

How the unit body 30 separates the collected liquid 14 into the carrier liquid and toner and other solids (toner hereinafter) is as follows. The flow control valve 18 causes the liquid 14 collected in the liquid tank 16 to fall to the foam block 41 of the unit body 30 in drops at a preselected adequate rate. At this instant, the power supply 47 applies a voltage of about 44 kV to the electrode 44. The liquid 14 dropped to the foam block 41 sequentially migrates downward by being absorbed by the cells of the block 41, i.e., the liquid 14 is temporarily trapped by the block 41. As a result, the foam block 41 holds the toner contained in the liquid 14 while passing the carrier liquid 24 therethrough.

The foam block 41 controls the spread of the liquid 14 flowing down therein. Therefore, the part of the liquid 14 around the inlet of the foam block 41 and having a high toner content and the part of the liquid 14 around the outlet of the block 41 and having a low toner content due to an electric field are prevented from being mixed together. That is, the foam block 41 causes a minimum of liquid 14 containing the toner to reach the outlet thereof. This successfully recovers only the carrier liquid 24 from the collected liquid 14 and allows it to be reused for development.

Further, the voltage applied to the electrode 44 at the non-electrodeposition side causes the positively charged toner to deposit on those cells of the foam block 41 adjoining the electrode 43 and the surface of the electrode 43.

Moreover, because the gap between the electrodes 43 and 44 sequentially decreases from the top to the bottom it slows down the flow of the liquid 14 in the foam body 21 and thereby subjects the liquid 14 to the restraint of the electric field over a long period of time. In addition, the electric field sequentially increases in strength as the liquid 14 flows down in the foam block 41, trapping more of the toner by electrodeposition and recovering the carrier liquid 24 in a purer form. It should be noted that the gap broader at the top than at the bottom allows the toner to evenly deposit on the entire electrode 43 without concentrating at the upper portion of the electrode 43. This is successful to prevent the upper portion of the foam block 41 from being stopped up and thereby extending the life of the block 41.

It is noteworthy that the cell diameter (about 700 $\mu$m) of the foam block 41 greater than the mean particle size (0.1 to 10 $\mu$m) of the toner promotes the fast separation of the solid toner and carrier liquid 24.

The carrier liquid 24 recovered by the foam block 41, as stated above, falls into the carrier tank 23 in drops due to gravity. A pump or similar conveying means, not shown, conveys the recovered carrier liquid 24 from the carrier tank 23 to the developing units 4 for reuse.

Assume that the cells of the foam block 41 are stopped up by the toner due to a long time of use, lowering the separating ability of the block 41. Then, the unit body 30 is bodily replaced with a new unit body.

With the above construction and operation, the carrier separating unit 20 separates the collected developing liquid 14 into the carrier liquid 24 and toner and thereby efficiently recovers the carrier liquid 24. The recovered carrier liquid 24 can be again used by the developing units 4.

The cell diameter of the foam block 41 of about 700 $\mu$m is only illustrative and is determined in accordance with the particle size of the toner. For example, when the toner has a mean particle size of 0.1 $\mu$m to 10 $\mu$m, the foam block 41 may have a cell diameter of 20 $\mu$m to 1,000 $\mu$m.

Also, the gap between the electrodes 43 and 44 which is 5 mm at the top and 2 mm at the bottom is, of course, only illustrative. The crux is that the distance between the electrodes 43 and 44 be great enough to form the electric field. Specifically, the thickness of the foam block 41 may be varied to optimize the strength of the electric field for the separation of the developing liquid 14.

As for the polarity of the bias, the electrodes 43 and 44 should only be so biased as to form a sufficient electric field without regard to the polarity of the charged toner. In this sense, the polarity of the collected developing liquid 14 and that of the bias shown and described are not limitative.

While the above embodiment has concentrated on a full-color image forming apparatus using a developing liquid and including an intermediate transfer body, it is similarly practicable with a full-color or a monochromatic image forming apparatus not including the intermediate transfer body.

A modification of the above embodiment will be described hereinafter. In the illustrative embodiment, the entire foam block 41 is assumed to have cells. The modification to be described uses a foam block having its continuous cells open at its surfaces parallel to the direction of migration of the collected developing liquid 14, but not contacting the flat electrodes, stopped up by a filler.

Figure 4B:
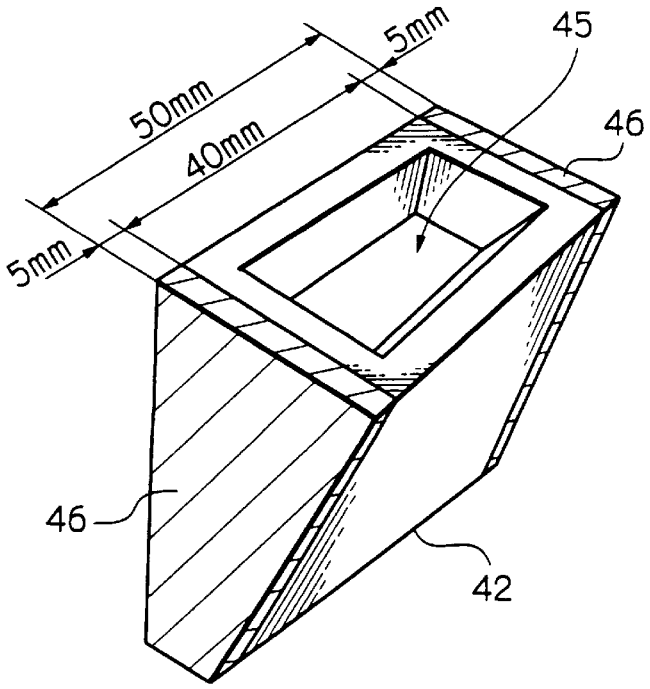
FIG. 4B is a view showing a modification of the first embodiment.

Specifically, as shown in FIG. 4B, the foam block of the modification, labeled 42, includes a recess 45. The surfaces 46 of the foam block 42 parallel to the direction of migration of the liquid 14, but not contacting the flat electrodes are impregnated with a two-part epoxy resin to a depth of about 5 mm, as indicated by hatching. The resin when solidified stops up the cells open at the above surfaces 46 of the foam block 42 and thereby prevents the collected liquid 14 from leaking via such surfaces 46 of the foam block 42.

If desired, the two-part epoxy resin impregnated and solidified in the above particular surfaces 46 of the foam block 42 may be replaced with flat members void of cells and adhered to the same surfaces of the block 42.

Another modification of the illustrative embodiment will be described hereinafter. This modification is different from the embodiment in that it includes a carrier separating portion made up of a plurality of gaps for dealing with the collected developing liquid 14.

Figure 5:
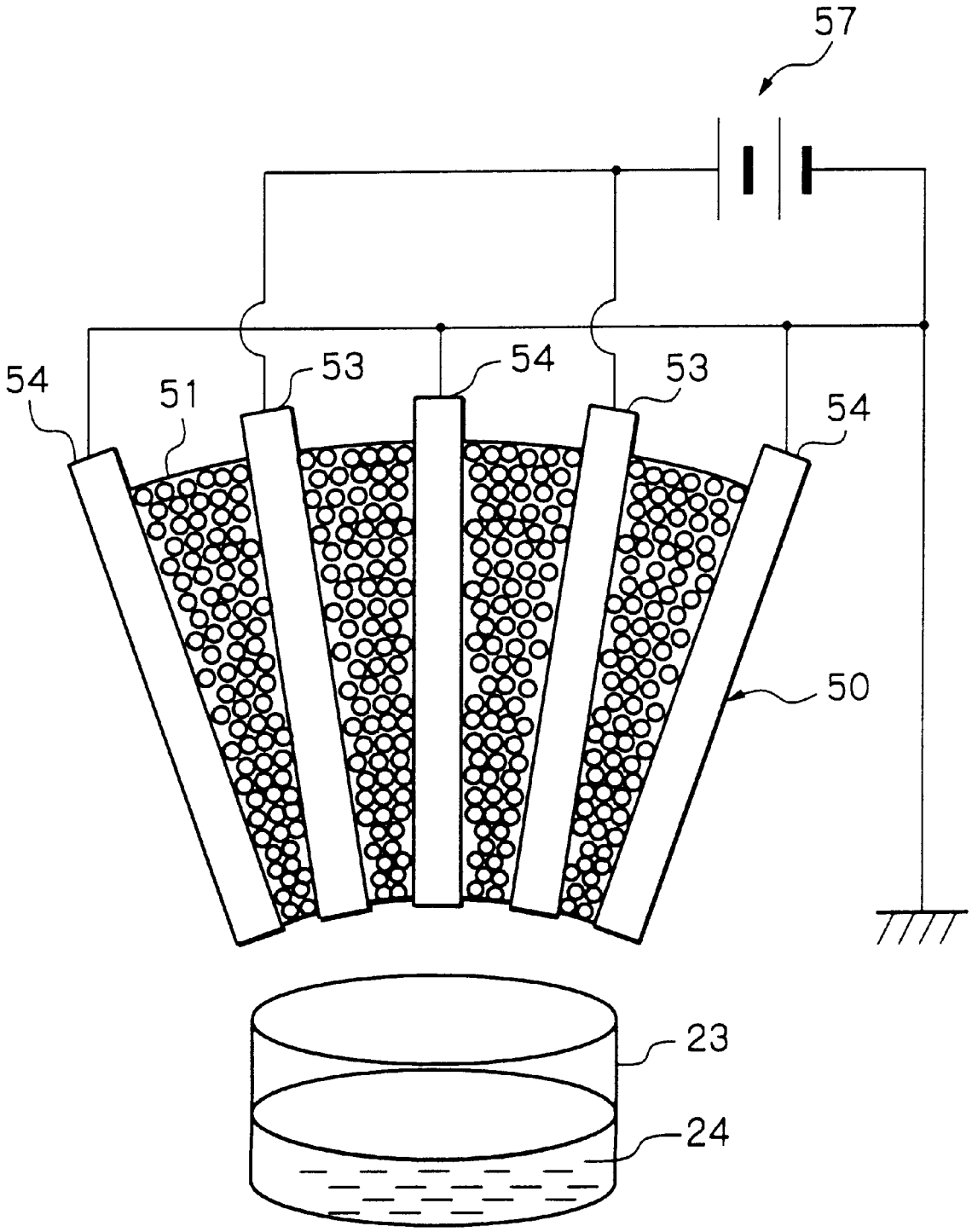
FIG. 5 is a view showing another modification of the first embodiment.

Specifically, as shown in FIG. 5, a carrier separating portion 50 includes three flat electrodeposition electrodes 54 and two flat non-electrodeposition electrodes 53 alternating with each other. A foam block 51 having continuous cells is disposed in each gap between the adjoining electrodes 53 and 54. The gap between the adjoining electrodes 53 and 54 is sized 5 mm at the top to which the collected liquid 14 drops and sized 2 mm at the bottom where the separation ends. A power supply 57 applies a voltage of 4 kV to each non-electrodeposition electrode 53. The electrodeposition electrodes 54 are connected to ground.

The second modification increases the electrodeposition area for retaining the toner and can deal with a great amount of collected liquid 14 at a time. The toner is efficiently electrodeposited in the cells of the foam blocks 51 adjoining the electrodes 54 and on the surfaces of the electrodes 54, allowing the carrier liquid 24 to be surely recovered. The second modification, like the illustrative embodiment, extends the life of the foam blocks 51.

Second Embodiment

This embodiment differs from the first embodiment in that it applies a plurality of different voltages to the non-electrodeposition electrode for sequentially intensifying the electric field in the direction in which the collected developing liquid 14 migrates.

Figure 6A:
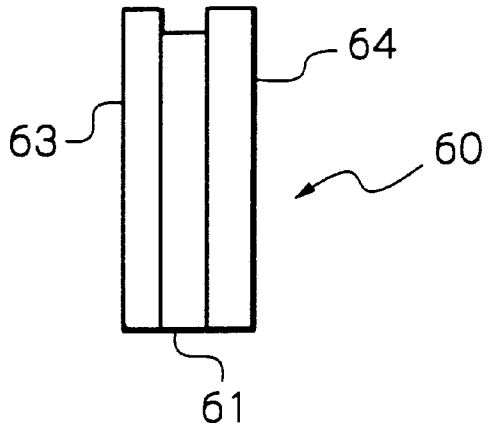
FIGS. 6A and 6B are views showing a second embodiment of the present invention.

Specifically, as shown in FIG. 6A, a carrier separating portion 60 includes a flat electrodeposition electrode 63 and a flat non-electrodeposition electrode 64 having quadrisected conductive portions. The two electrodes 63 and 64 are parallel to each other and spaced by a gap of 2 mm. A foam block 61 having continuous cells is positioned between the electrodes 63 and 64. The electrodes 63 and 64 each are sized 100 mm in the lengthwise direction and 50 mm in the widthwise direction.

Figure 6B:
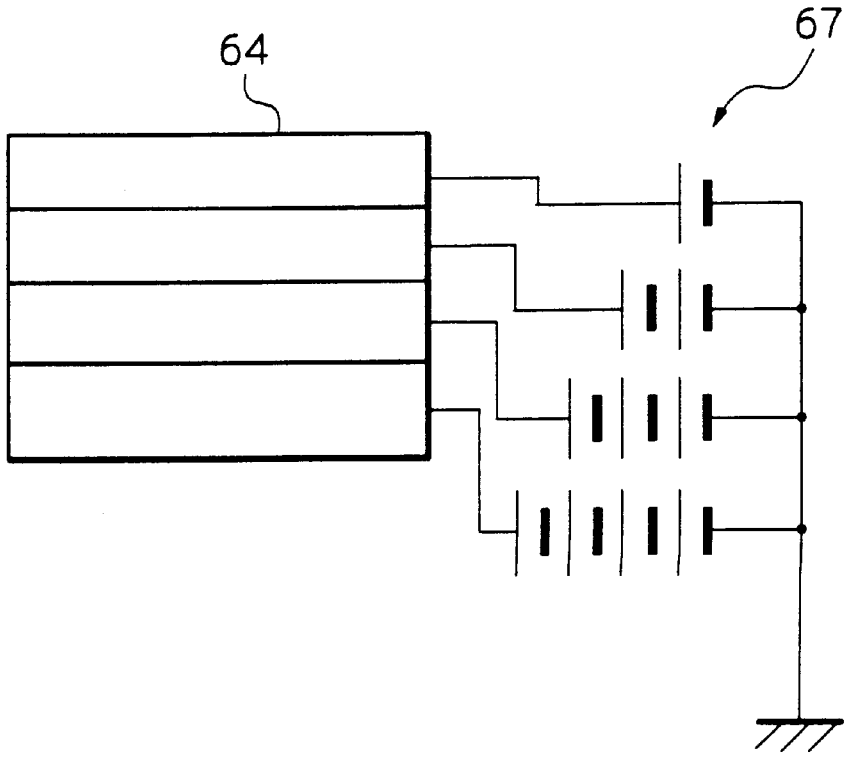

FIG. 6B shows the non-electrodeposition electrode 64 with the quadrisected conductive portions more specifically. To produce the electrode 64, a block of phenol resin or similar insulating resin is coated with copper or similar conductor and then etched to quadrisect the conductive portion. As shown in FIG. 6B, a power supply 67 applies four different voltages of 1 kV, 1.5 kV, 2 kV and 3 kV to the four portions of the electrode 64, respectively, from the top to the bottom.

In the above configuration, despite that the electrodes 63 and 64 are parallel to each other, the electric field can be sequentially increased in strength in the direction in which the collected liquid 14 migrates in the foam block 61. The toner can therefore be electrodeposited on the electrode 63 which allows the carrier liquid 24 to be separated therefrom.

In the second embodiment, the gap between the parallel electrodes 63 and 64 is selected to be 2 mm. However, the crux is that the distance between the electrodes 63 and 64 be great enough to form the electric field. For example, when the gap is 0.5 mm to 5.0 mm, the thickness of the foam block 61 may be varied to optimize the strength of the electric field for the separation of the developing liquid 14.

Figure 7A:
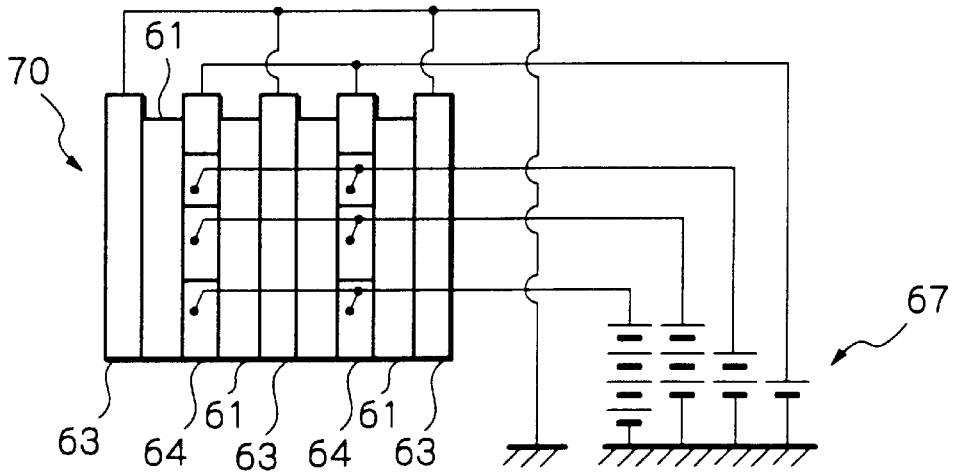
FIGS. 7A and 7B are views showing a modification of the second embodiment.
Figure 7B:
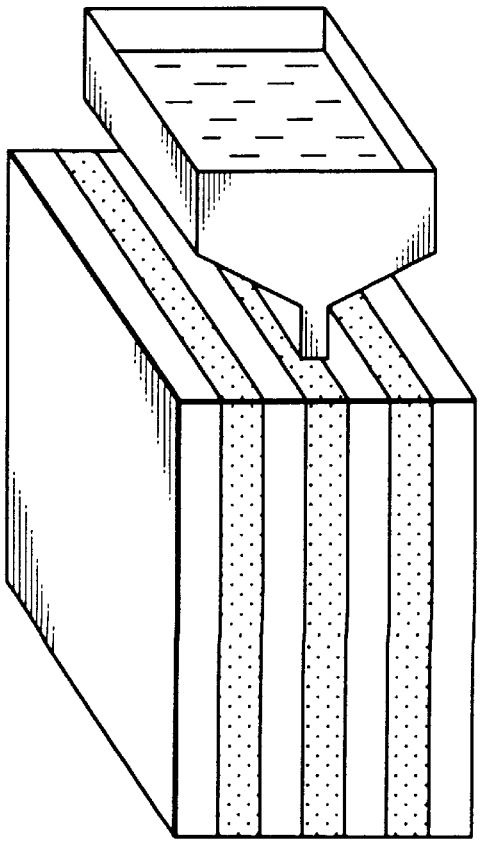

FIG. 7A shows a modification of the second embodiment including a plurality of flat electrodes 63 and 64 and a plurality of foam blocks 61 each having continuous cells. As shown, a carrier separating portion 70 includes three flat electrodeposition electrode 63 and two flat non-electrodeposition electrodes 64 alternating with each other. The electrodes 63 and 64 are parallel to each other and spaced by a gap of 2 mm. A foam block 61 having continuous cells is interposed between the nearby electrodes 63 and 64. FIG. 7B shows the carrier separating portion 70 in an oblique view. As shown in FIG. 7A the two non-electrodeposition electrodes 64 each are divided into a plurality of portions (four portions in the modification). A power supply 67 applies four different voltages of 1 kV, 1.5 kV, 2 kV and 3 kV to the four divided portions of each of the electrodes 64, respectively, from the top to the bottom. The electrodes 63 are connected to ground.

The above modification increases the electrodeposition area for retaining the toner and can deal with a great amount of collected liquid 14 at a time. The toner charged to positive polarity is efficiently electrodeposited, allowing the carrier liquid 24 to be surely recovered. In addition, the modification extends the life of the foam blocks 61.

Third Embodiment

In the first and second embodiments shown and described, the carrier collecting device 12 is provided alone independently of the drum cleaning unit 6 and belt cleaning unit 7. In a third embodiment to be described, a particular carrier collecting device is constructed integrally with each of the drum cleaning unit 6 and belt cleaning unit 7.

Figure 8:
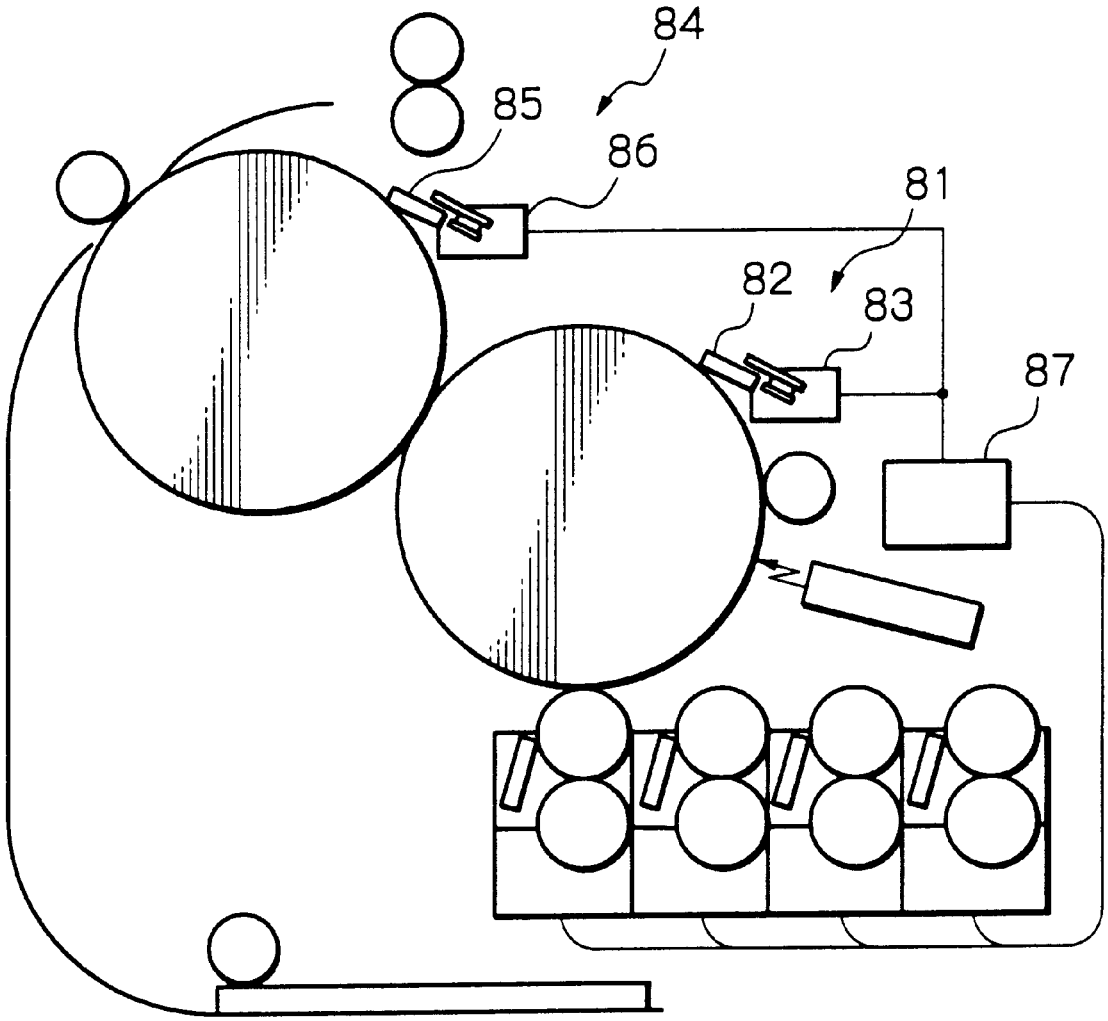
FIG. 8 is a view showing the generation construction of a third embodiment of the present invention.

Specifically, as shown in FIG. 8, a drum cleaning unit 81 includes a cleaning blade 82 and a carrier collecting device 83 constructed integrally with the blade 82. The carrier collecting device 83 has a width equal to or greater than the width of the cleaning blade 82. Likewise, a belt cleaning unit 84 includes a cleaning blade 85 and a carrier collecting device 86 constructed integrally with the blade 85. This embodiment makes it needless to provide a single carrier collecting device and cause it to deal with the entire developing liquid. This, coupled with the fact that each carrier separating portion has a broad separating area, allows the viscous collected liquid 14 to be efficiently dealt with.

The carrier liquid 24 separated by each of the carrier collecting devices 83 and 86 is stored in a tank 87 and supplemented to each developing unit, as needed.

The first to third embodiments shown and described achieve various advantages enumerated below.

(1) While the developing liquid collected by the cleaning means flows through a gap between electrodes, toner and other solids contained in the liquid are electrodeposited on one of the electrodes while only a liquid is passed through the gap. As a result, the developing liquid is separated into the solids and liquid, and the liquid can be reused. Because the electric field is sequentially intensified in the direction in which the liquid migrates, the solids can be evenly deposited on the entire surface of the electrode without concentrating at the upper portion of the electrode.

(2) A foam block having continuous cells is positioned between the electrodes for controlling the spread of the collected liquid. The foam block causes the solids of the collected liquid to move to and remain at a preselected position due to the action of the electric field. This is also successful to recover only the carrier liquid from the collected liquid. The foam block controlling the spread of the collected liquid prevents part of the liquid around the inlet of the block and having a high solid content and part of the liquid around the outlet of the same and having a low solid content from being mixed together. Consequently, the collected liquid containing the solids is prevented from reaching the outlet. This insures the separation of the carrier liquid from the collected liquid and allows it to be reused.

(3) Because the foam block has a cell diameter of 20 $\mu$m to 1,000 $\mu$m, the solids of the collected liquid are sufficiently subjected to the action of the electric field while migrating through the cells of the block. The solids can therefore be surely moved in and trapped by the foam block.

(4) The separating means has a solid retaining area broad enough to efficiently separate the collected liquid into the liquid and solids. In addition, the foam block achieves an extended life.

(5) The distance between the electrodes sequentially decreases in the direction in which the collected liquid migrates. This slows down the flow of the liquid through the gap between the electrodes and thereby subjects the liquid to the restraint of the electric field over a long period of time, insuring the electrodeposition of the solids, i.e., the recovering of the liquid. In addition, the solids are prevented from stopping up the upper portion of the foam block. This also extends the life of the foam block.

(6) One of the electrodes is divided into a plurality of portions in the direction of migration of the collected liquid. Different biases are respectively applied to the above portions and sequentially increase in strength in the direction of migration of the collected liquid. Therefore, even when the electrodes are positioned in parallel to each other, the electric field can be sequentially intensified in the above direction. This not only simplifies the construction, but also extends the life of the foam block.

(7) Cells open at the side surfaces of the foam block parallel to the direction of migration of the collected liquid, but not contacting the electrodes, are stopped up by a filler. This prevents the liquid from leaking via the side surfaces.

(8) The separating means can be constructed integrally with the cleaning means, so that residual liquid does not have to be collected at a single location. Moreover, the separating means achieves an improved separating ability and an extended life.

Fourth Embodiment

This embodiment is essentially similar to the previous embodiments as to the carrier collecting device 12 and unit body 30. The following description will therefore concentrate on differences between this embodiment and the previous embodiments.

Figure 9:
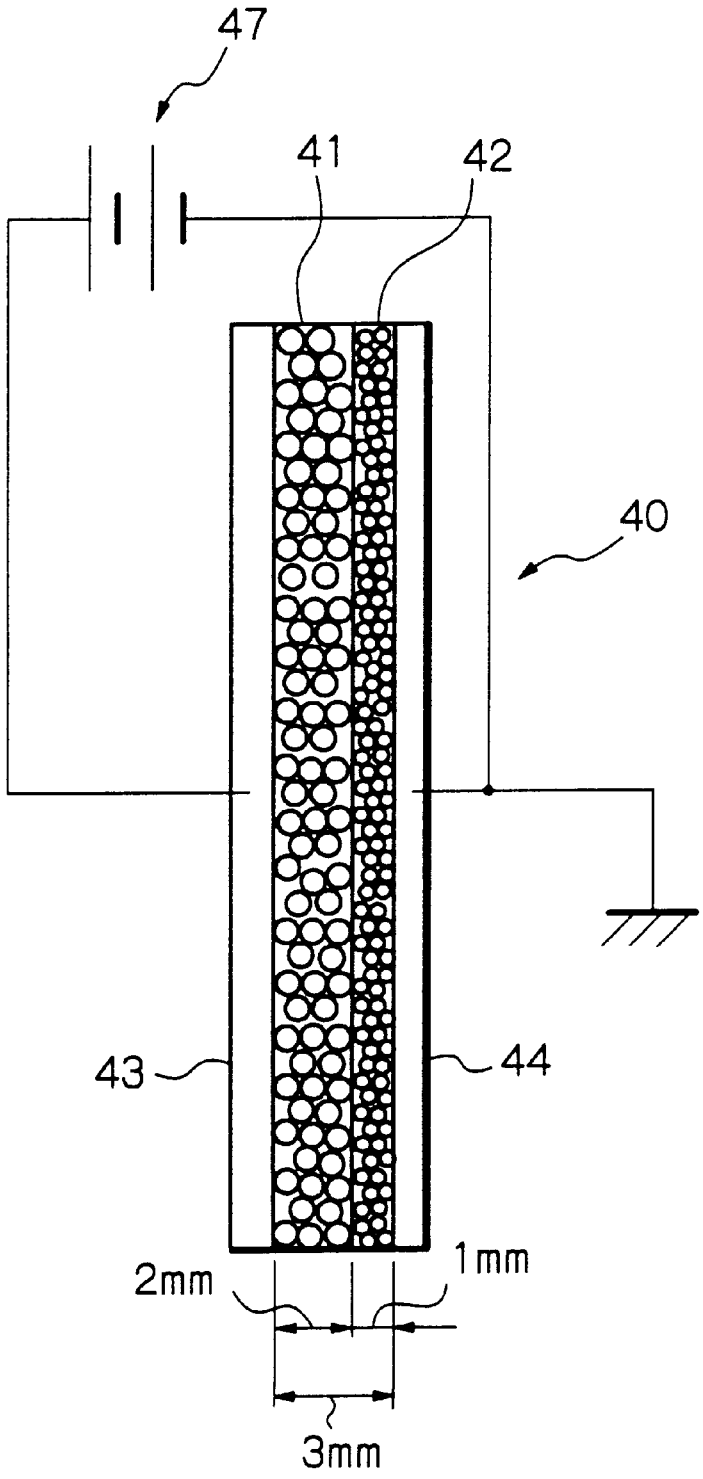
FIG. 9 is a view showing a fourth embodiment of the present invention.

As shown in FIG. 9, in the fourth embodiment, the carrier separating portion 40 includes two foam blocks 41 and 42 each having continuous cells, a flat non-electrodeposition electrode 43, and a flat electrodeposition electrode 44. The two electrodes 43 and 44 are spaced by a gap of 3 mm, and each are sized 100 mm in the lengthwise direction and 50 mm in the widthwise direction. The foam block 41 is 2 mm thick and mounted on the electrode 43 and has a tridimensional mesh structure whose cell diameter is about 700 $\mu$m. The other foam block 42 is 1 mm thick and mounted on the electrode 44 and has a tridimensional mesh structure whose cell diameter is about 350 $\mu$m. A power supply 47 applies a voltage to the electrode 43. The electrode 44 is connected to ground.

During the separation of the collected liquid 14, a voltage of 3.5 kV is applied to the non-deposition electrode 43, causing the foam blocks 41 and 42 to prevent the liquid 14 from spreading. The voltage applied to the electrode 43 causes the toner of positive polarity to move to and remain in the cells of the foam block 42 and on the surface of the electrode 44 contacting the foam block 42 (electrodeposition). because the cell diameter of the foam block 42 on the electrodeposition side is smaller than the cell diameter of the foam block 41 on the non-electrodeposition side, the block 42 successfully limits the flow rate of the liquid 14 having a high toner content and thereby increases the restraint of the electric field to act.

The foam block 41 on the non-electrodeposition side and having a cell diameter of about 700 $\mu$m allows the carrier liquid to flow therethrough relatively easily. In addition, the cell diameter of the foam block 41 and that of the foam block 42 are greater than the mean particle size of the solids including toner (0.1 $\mu$m to 10 $\mu$m). the toner and carrier liquid 24 can therefore be rapidly separated from each other.

Again, when the cells of the foam blocks 41 and 42 are stopped up by the toner and other solids due to a long time of use, the unit body 30 is bodily replaced with a new unit body.

The cell diameter of the foam block 42 on the electrodeposition side which is about 350 $\mu$m and the cell diameter of the foam block 41 on the non-electrodeposition side which is about 700 $\mu$m are only illustrative and are determined in accordance with the particle size of the toner, as in the previous embodiments. For example, when the toner has a mean particle size of 0.1 $\mu$m to 10 $\mu$m, the foam blocks 41 and 42 each may have a cell diameter of 20 $\mu$m to 1,000 $\mu$m.

Also, the gap between the electrodes 43 and 44 which is 3 mm is, of course, only illustrative. The thickness of the foam blocks 41 and 42 may be varied to optimize the strength of the electric field for the separation of the collected liquid 14.

As for the polarity of the bias, the electrodes 43 and 44 should only be so biased as to form a sufficient electric field without regard to the polarity of the toner, as in the previous embodiments. Further, PCS-TEXT this embodiment is also similarly practicable with a full-color or a monochromatic image forming apparatus not including the intermediate transfer body.

Fifth Embodiment

Figure 10A:
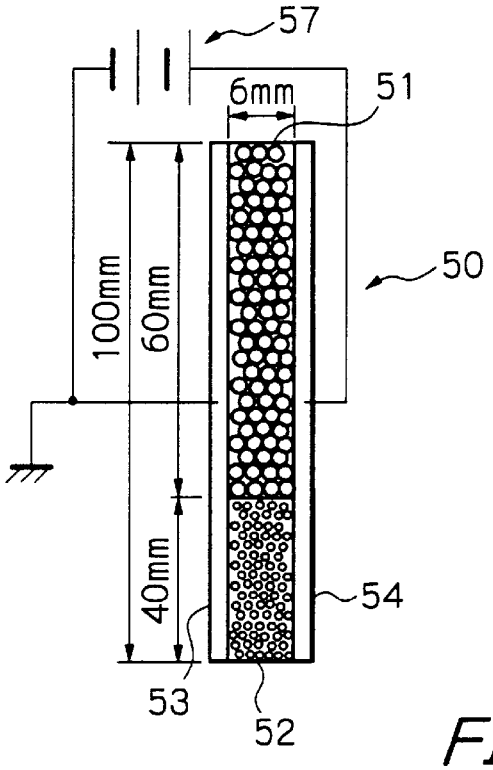
FIG. 10A is a view showing a fifth embodiment of the present invention.

Referring to FIG. 10A, a fifth embodiment of the present invention will be described. In the fourth embodiment, the foam blocks 41 and 42 are positioned in parallel to each other in the direction perpendicular to the direction of migration of the collected liquid 14. As shown in FIG. 10A, a carrier separating portion 50 of the fifth embodiment includes a foam block 51 having continuous cells and a continuous foam block 52 having continuous cells and positioned beneath or downstream of the block 51 in the direction of migration of the collected liquid 14. The upstream foam block 51 has a cell diameter of about 700 $\mu$m and extends over about 60 mm while the downstream foam block 52 has a cell diameter of about 350 $\mu$m and extends over about 40 mm. A flat non-electrodeposition electrode 54 is connected to a 4 kV power supply 57 for the separation of the collected liquid 14. A flat electrodeposition electrode 53 is connected to ground. The two electrodes 53 and 54 are spaced by a gap of 6 mm.

The foam block 52 beneath the foam block 51 and smaller in cell diameter than the block 51 successfully slows down the migration of the collected liquid through the blocks 51 and 52. This, coupled with the restraint of the electric field acting on the liquid 14 over a longer period of time than in the fourth embodiment, allows the solid toner to evenly deposit on the entire surface of the electrodeposition electrode 53. Consequently, the carrier liquid 24 can be recovered from the collected liquid in a purer form.

Figure 10B:
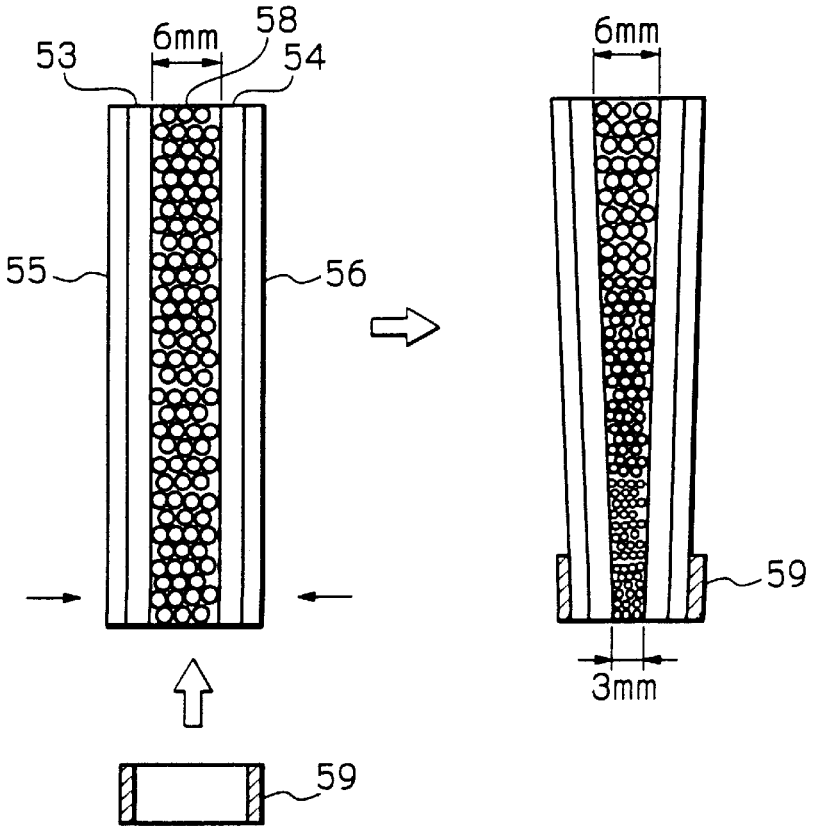
FIG. 10B is a view showing a modification of the fifth embodiment.

In the fifth embodiment, the foam blocks 51 and 52 each have a tridimensional mesh structure which is not elastically deformable. If desired, use may be made of foam blocks formed of polyurethane or similar elastically deformable material. For example, in a modification of the illustrative embodiment shown in FIG. 10B, a continuous foam block 58 having a cell diameter of about 700 $\mu$m is sandwiched between the electrodes 53 and 54 and insulating plates 55 and 56 respectively contacting the electrodes 53 and 54. An annular retainer member 59 is fitted on the outlet of the above assembly while causing the foam block 58 to elastically deform, as illustrated. As a result, the gap between the electrodes 53 and 54 is reduced to 3 mm at the bottom. Because the deformation of the foam block 58 sequentially increases from the top to the bottom, as viewed in FIG. 10B, the foam block 58 can have a cell diameter of about 700 $\mu$m at the top or inlet and a cell diameter of about 350 $\mu$m at the bottom or outlet. It was experimentally found that the modification of FIG. 10B is comparable with the embodiment of FIG. 10A with respect to the separation of the carrier liquid.

Sixth Embodiment

Figure 11A:
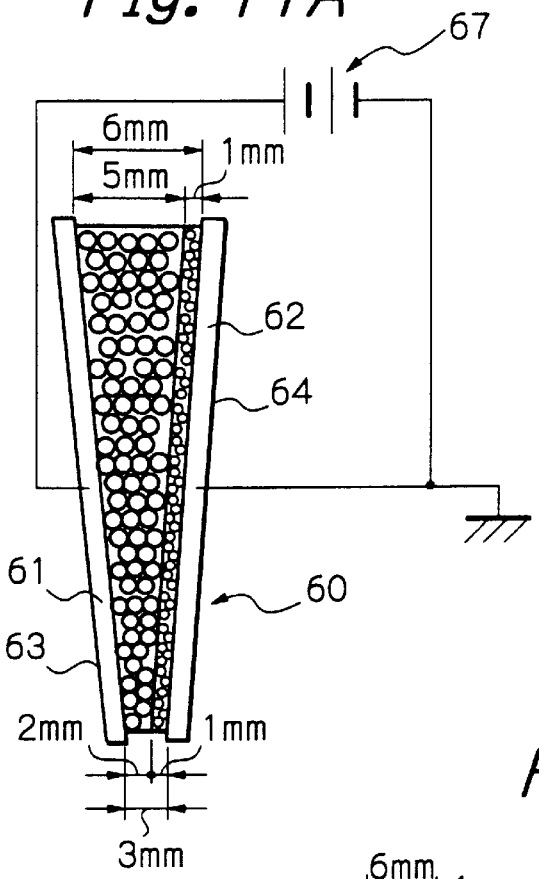
FIG. 11A is a view showing a sixth embodiment of the present invention.

A sixth embodiment of the present invention will be described with reference to FIG. 11A. As shown, a carrier separating portion 60 includes flat electrodes 63 and 64 spaced from each other by a gap of 6 mm at the upper end to which the collected liquid 14, not shown, drops and by a gap of 3 mm at the bottom where the separation ends. The electrode 63 is located at the non-deposition side and applied with a positive bias. A foam block 61 having continuous cells is mounted on the electrode 63 and has a tridimensional mesh structure having a cell diameter of about 700 $\mu$m and not elastically deformable. The foam block 61 is 5 mm thick at its upper portion and 2 mm thick at its lower portion. A foam block 62 having continuous cells is mounted on the other or electrodeposition electrode 64 and has a tridimensional mesh structure having a cell diameter of about 350 $\mu$m and not elastically deformable. The foam block 62 is 1 mm thick from the top to the bottom. In this manner, the thickness of the foam block 61 is sequentially reduced from the top to the bottom so as to sequentially reduce the gap between the electrodes 63 and 64.

A power supply 67 applies a voltage of 4 kV to the electrode 63. The electrode 64 is connected to ground. Because the gap between the electrodes 63 and 64 sequentially decreases from the top to the bottom, it slows down the migration of the collected liquid 14 in the foam blocks 61 and 62 and thereby subjects the liquid 14 to the restraint of the electric field over a longer period of time than in the fifth embodiment. Moreover, the electric field between the electrodes 63 and 64 sequentially increasing in strength toward the bottom allows the toner to be electrodeposited in the cells of the foam block 62 and on the electrode 64. This not only increases the separating ability of the carrier separating portion 60, but also renders the recovered carrier liquid 24 purer.

Figure 11B:
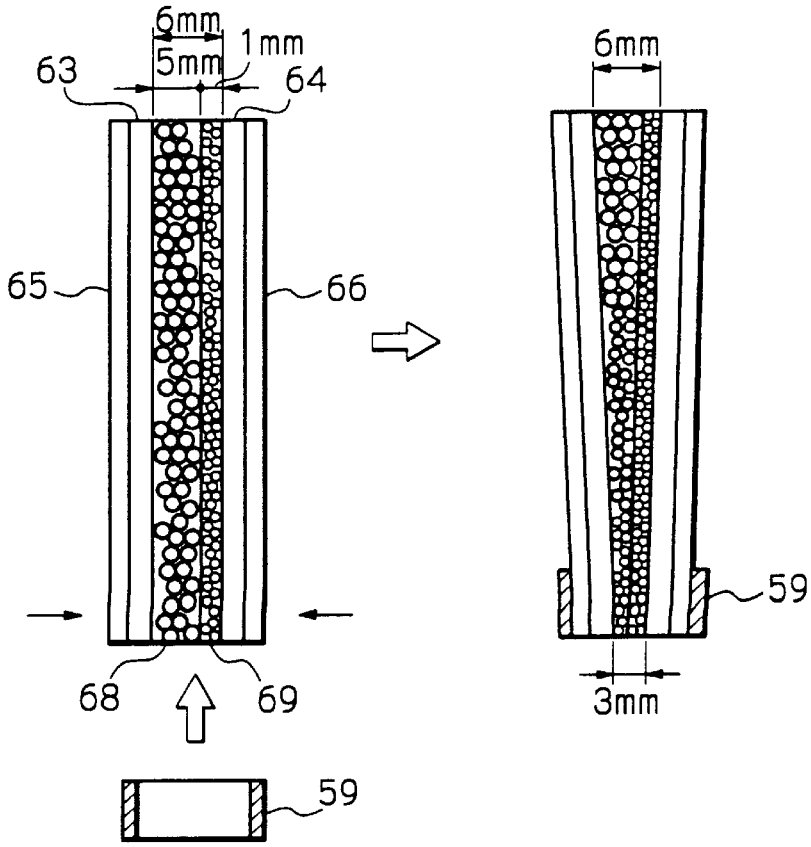
FIG. 11B is a view showing a modification of the sixth embodiment.
Figure 12:
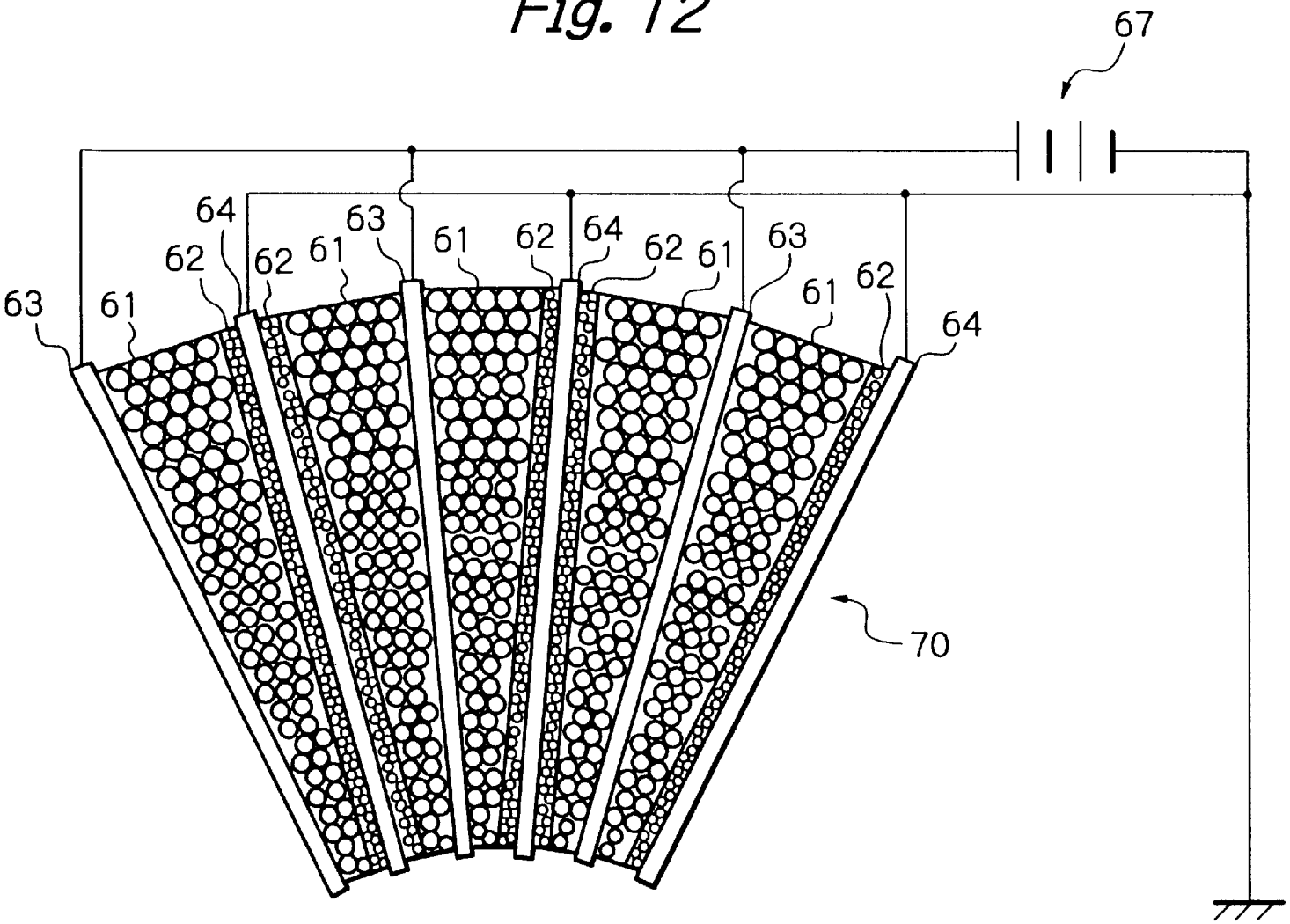
FIG. 12 is a view showing a seventh embodiment of the present invention.

In the above embodiment, the foam blocks 61 and 62 each are not elastically deformable. FIG. 11B shows a modification of the illustrative embodiment in which the foam blocks are elastically deformable. As shown, a 5 m thick, elastically deformable foam block 68 having continuous cells is mounted on the non-electrodeposition electrode 63 and has a cell diameter of about 700 $\mu$m. A 1 mm thick foam block 69 having continuous cells is mounted on the electrodeposition electrode 64 and has a tridimensional mesh structure whose cell diameter is about 350 $\mu$m. Insulating plates 65 and 66 sandwich the foam blocks 68 and 69 from opposite sides. An annular retainer member 59 is fitted on the lower portion of the above assembly so as to reduce the gap between the electrodes 63 and 64 to 3 mm at the bottom or outlet. By causing the foam blocks 68 and 69 to deform by compression, as shown in FIG. 11B, the carrier liquid can be separated from the collected liquid 14 as efficiently as in the embodiment of FIG. 11A.

Seventh Embodiment

This embodiment is essentially similar to the sixth embodiment except that it includes a carrier separating portion 70 made up of five gaps for separating the carrier liquid 24 from the collected liquid 14. As shown, the carrier separating portion includes a plurality of flat electrodes 63 and a plurality of flat electrodes alternating with each other. A power supply 67 applies a bias of 4 kV to the electrodes 63. The electrodes 64 are connected to ground.

With this configuration, the illustrative embodiment increases the electrodeposition area for retaining the toner and can deal with a great amount of collected liquid 14 at a time. This realizes efficient electrodeposition of the solid, i.e., efficient recovering of the carrier liquid 24. In addition, the illustrative embodiment extends the life of the foam blocks 61 and 62.

Eighth Embodiment

The embodiments shown and described each separate the collected liquid 14 into the carrier liquid 24 and solids including toner by using an electric field and gravity. This embodiment uses vacuum in addition to the electric field and gravity for effecting the separation. Specifically, the carrier collecting device 12 forcibly sucks the carrier liquid 24 via the bottom of the unit body 30, not shown, with a suction pump or similar sucking means. Experiments showed that suction, coupled with the electric field and gravity, separates a great amount of collected liquid 14 in a short period of time and thereby noticeably increases the separating ability of the carrier collecting device 12.

Ninth Embodiment

In the fourth to eighth embodiments, the carrier collecting device 12 is provided alone independently of the drum cleaning unit 6 and belt cleaning unit 7. In a ninth embodiment to be described, a particular carrier collecting device is constructed integrally with each of the drum cleaning unit 6 and belt cleaning unit 7.

Specifically, in the image forming apparatus shown in FIG. 1, the drum cleaning unit 6 includes a cleaning blade, not shown, and a foam block, not shown, having continuous cells and interposed between a pair of flat electrodes, not shown. The foam block has a width equal to or greater than the width of the cleaning blade. The belt cleaning unit 7 is essentially identical in configuration with the drum cleaning unit 6. This embodiment makes it needless to provide a single carrier collecting device and cause it to deal with the entire developing liquid. This, coupled with the fact that each carrier separating portion has a broad separating area, allows the viscous collected liquid to be efficiently dealt with.

The above fourth to ninth embodiments also achieve the various advantages previously described in relation to the first to third embodiments. Further, in the fourth to ninth embodiments, the small cells at the electrodeposition side trap the solids while the large cells at the non-electrodeposition side allow the collected liquid to easily pass therethrough. It follows that a minimum of solids is allowed to flow out of the foam block, i.e., only the liquid is efficiently recovered from the collected liquid. In addition, the cell diameter of the foam block is sequentially reduced in the direction of migration of the collected liquid so as to slow down the flow of the liquid in the block. This is also successful to subject the collected liquid to the restraint of the electric field over a long period of time.

Tenth Embodiment

Figure 13:
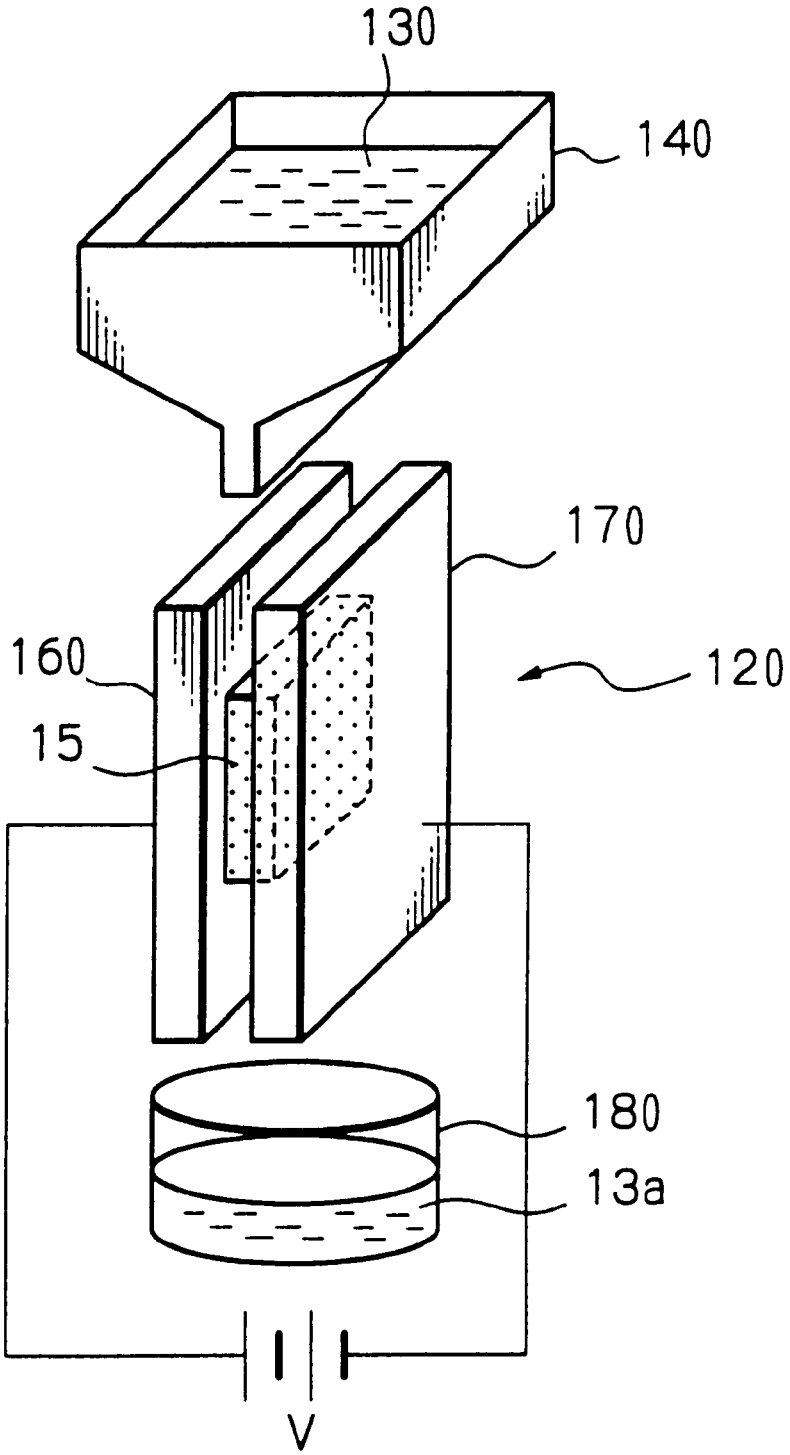
FIG. 13 is a view showing a tenth embodiment of the present invention.

Referring to FIG. 13, a tenth embodiment of the present invention will be described. As shown, a carrier separating unit 120 includes a foam block 15 having continuous cells and a pair of flat electrodes 160 and 170 sandwiching the block 15. The foam block 15 is affixed to the electrodes 160 and 170 by adhesive. A power supply V applies a bias for forming an electric field between the electrodes 160 and 170.

In the above configuration, a collected developing liquid 130 is introduced into a liquid tank 14 and then caused to fall to the top of the foam block 16 in drop at a preselected adequate rate. The liquid 130 sequentially penetrates into the foam block 15. Solids including toner and contained in the liquid 130 are electrodeposited on one of the electrodes 160 and 170 via the foam block 15 and retained in the cells of the block 15. On the other hand, a carrier liquid 13*a* also contained in the liquid 130 flows down through the cells of the foam body 15 due to gravity and falls into a carrier tank 180 in drops.

While the liquid 130 containing toner sequentially drops to the foam block 15, the cells of the block 15 controls the spread of the liquid 130. This prevents the part of the liquid 130 just dropped to the foam block 15 and having a high toner content and the part of the same present in the lower portion of the block 15 and having a low toner content from being mixed together. That is, the liquid 130 with toner does not reach the carrier tank 180 via the foam block 15. It follows that only the carrier liquid 13*a* be recovered from the collected liquid 130 and again used for development.

The cell diameter of the foam block 15 is mainly determined in accordance with the particle size of toner to be removed. For example, when toner has a mean particle size of 0.1 $\mu$m to 10 $\mu$m, the cell diameter of the foam block 15 should preferably be 20 $\mu$m to 1,000 $\mu$m. Why toner with such a particle size does not pass through the foam block 15 whose cell diameter is 20 μm to 1,000 μm is presumably because the toner subjected to the restraint of the electric field migrates toward the electrode and coheres itself in the size of several ten to several hundred microns.

The bias for forming the electric field and the distance between the electrodes 160 and 170 are open to choice so long as they allow a sufficient electric field to be formed between the electrodes 160 and 170 and prevent abnormal discharge from occurring between the electrodes 160 and 170.

Experiments were conducted by use of a developing liquid, defining a gap of 2 mm between the electrodes 160 and 170, applying a bias of 3.5 V to the non-electrodeposition electrode 160, and connecting the electrodeposition electrode 170 to ground. The experiments showed that the above conditions are successful to collect a pure carrier liquid 13*a* entirely free from solids including toner. Cell diameters ranging from 35 μm to 700 μm were desirable in consideration of the life of the foam block 15 and the separation and electrodeposition time necessary for the solids.

Figure 14:
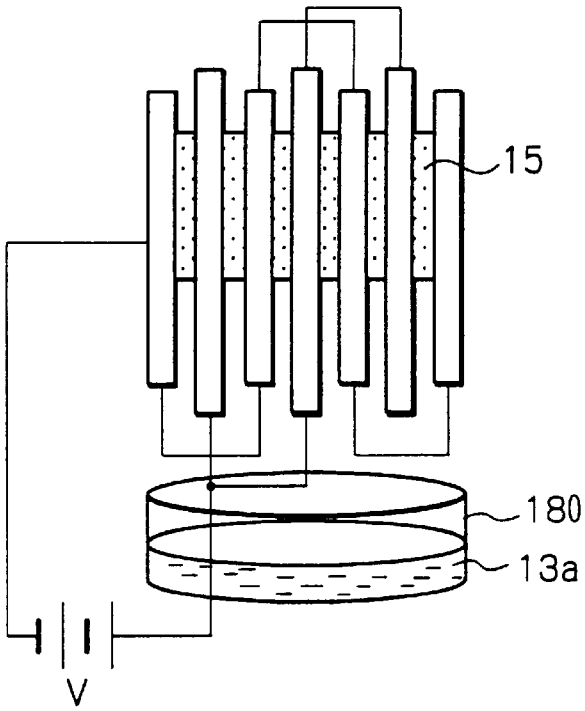
FIG. 14 is a view showing a modification of the tenth embodiment.

To broaden the electrodeposition area for toner and enhance efficient electrodeposition, a plurality of electrodes and a plurality of foam blocks 15 may be arranged alternately with each other, as will be described hereinafter. FIG. 14 shows a specific arrangement including seven flat electrodes and six foam blocks 15 each intervening between nearby foam blocks 15. A power supply V applies a ground potential and a voltage of 3.5 V to the consecutive electrodes alternately for forming electric fields between nearby electrodes. The voltage to be applied and the distance between nearby electrodes should only be suitably adjusted to implement a sufficient electrodeposition effect between the electrodes. With the configuration of FIG. 14, it is possible to broaden the area for treating the collected liquid 130 and therefore to efficiently recover the carrier liquid 13*a* from the liquid 130. In addition, the restraint to act on the toner is distributed to a plurality of foam blocks 15, so that the life of each foam block 15 is extended.

Figure 15:
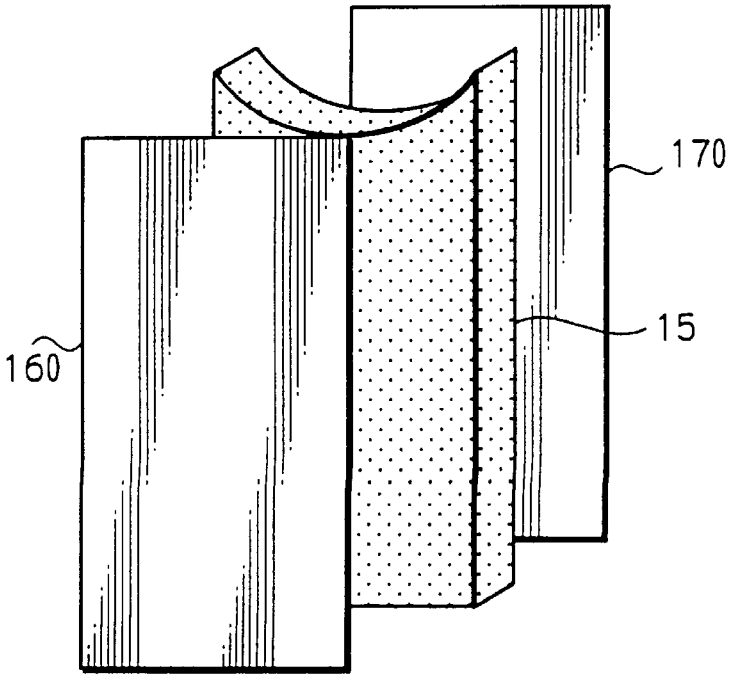
FIG. 15 is a view showing another modification of the tenth embodiment.

FIG. 15 shows another modification of the illustrative embodiment. As shown, the top of the foam block 15 is provided with concavity in the widthwise direction of the electrodes 160 and 170. The concavity prevents the collected liquid 130 dropped to the foam block 15 from flowing out of the top of the block 15.

Further, in the above embodiment, cells open at the side surfaces of the foam block 15 parallel to the direction of migration of the collected liquid 130, but not contacting the electrode 160 or 170, may be stopped up by, e.g., adhesive in order to prevent the liquid 130 from leaking via the above side surfaces.

Figure 16A:
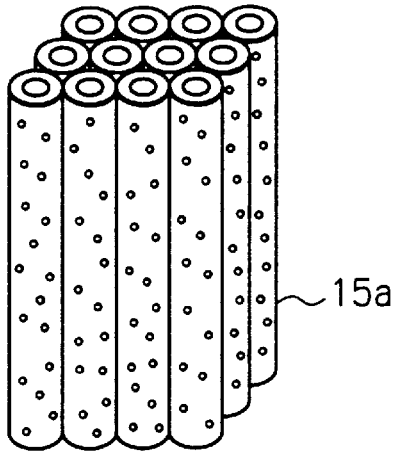
FIGS. 16A–16C are views each showing a particular configuration of a member included in the tenth embodiment for preventing a developing liquid from spreading.
Figure 16B:
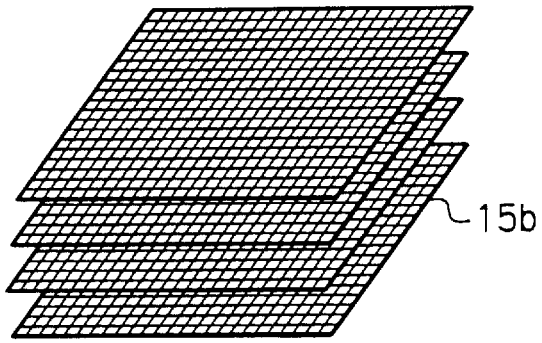
Figure 16C:
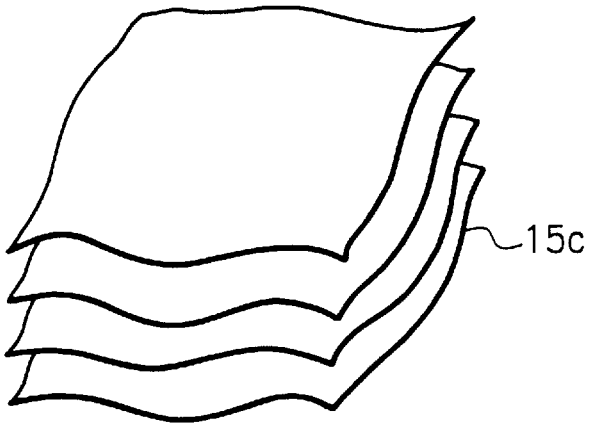

The foam block 15 may be replaced with any other suitable member capable of controlling the spread of the collected liquid 130. For example, FIG. 16A shows a bundle of pipes 15*a* each being formed with a number of through holes. FIG. 16B shows a laminate of mesh members 15*b*. Further, FIG. 16C shows a laminate of felt or similar unwoven cloths 15*c*.

In this embodiment, too, a particular carrier separating unit may be constructed integrally with each of the cleaning units 6 and 7. This configuration is advantageous for the reasons described previously. In addition, the illustrative embodiment may also include a suction pump or similar sucking means for forcibly recovering the carrier liquid 13*a* from the collected liquid 130.

Of course, the illustrative embodiment, like the previous embodiments, is practicable even with an image forming apparatus not using an intermediate transfer body. While the illustrative embodiment has been shown and described as removing the developing liquid left on the drum 1 and belt 5 after image transfer, it is also capable of removing a cleaning liquid (sometimes playing the role of a developing liquid at the same time) which may be fed to a photoconductive element or similar image carrier after image transfer.

Furthermore, in the illustrative embodiment, a latent image is formed on the drum 1 and then developed to form a toner image on the drum 1. The illustrative embodiment is similarly applicable to an image forming apparatus of the type directly forming a toner image on an image carrier with a toner-containing developing liquid, i.e., without forming a latent image.

The above embodiment also achieves the advantages described previously in relation to the first to third embodiments. In addition, this embodiments prevents the collected liquid from flowing out of the top of the foam block capable of controlling the spread of the collected liquid.

Various modifications will become possible for those skilled in the art after receiving the teaching of the present disclosure without departing from the scope thereof.

What is claimed is:

1. An image forming apparatus using a developing liquid comprising of a liquid and toner dispersed in said liquid, comprising:

a developing means for developing a latent image electrostatically formed on an image carrier by using the developing liquid to thereby form a corresponding toner image;

a transferring means for transferring the toner image from said image carrier to a recording medium;

a cleaning means for collecting the developing liquid left after image transfer for thereby effecting cleaning; and a separating means comprising at least two electrodes between which the developing liquid collected by said cleaning means is passed, wherein a particular potential is applied to each of said at least two electrodes for forming an electric field sequentially increasing in strength in a direction of migration of said developing liquid, whereby a charged solid component contained in said developing liquid is electrodeposited on either one of said at least two electrodes to thereby recover a liquid component from said developing liquid.

2. An apparatus as claimed in claim 1, wherein said separating means further comprises a member for controlling spread of the developing liquid and implemented by a foam block having a tridimensional mesh structure having a continuous cells.

3. An apparatus as claimed in claim 2, wherein said foam block has a cell diameter between 20 μm and 1,000 μm.

4. An apparatus as claimed in claim 1, wherein said separating means comprises at least three electrodes.

5. An apparatus as claimed in claim 1, wherein said electrodes are so arranged as to sequentially reduce a distance between said electrodes in the direction of migration of the developing liquid.

6. An apparatus as claimed in claim 1, wherein one of said electrodes is divided into a plurality of portions in the direction of migration of the developing liquid, said separating means applying biases sequentially increasing in said direction of migration of said developing liquid to said plurality of portions.

7. An apparatus as claimed in claim 1, wherein said separating means further comprises a foam block interposed between said electrodes and having cells open at surfaces thereof parallel to the direction of migration of the developing liquid, but not contacting said electrodes, stopped up by a filler.

8. An apparatus as claimed in claim 1, wherein said separating means is constructed integrally with said cleaning means.

9. An image forming apparatus using a developing liquid comprising of a liquid and toner dispersed in said liquid, comprising:

a developing means for developing a latent image electrostatically formed on an image carrier by using the developing liquid to thereby form a corresponding toner image;

a transferring means for transferring the toner image from said image carrier to a recording medium;

a cleaning means for collecting the developing liquid left after image transfer for thereby effecting cleaning; and a separating means comprising a member for controlling spread of the developing liquid collected by said cleaning means, wherein said developing liquid is caused to migrate through said member under the action of an electric field to thereby move a solid component contained in said developing liquid to a preselected position and retain said solid component at said preselected position, whereby a liquid component also contained in said developing liquid is recovered via said member;

said member comprising a foam block having a tridimensional mesh structure having continuous cells, said foam block having a cell diameter or a cell ratio varied in accordance with a potential of the electric field or a direction of migration of the developing liquid.

10. An apparatus as claimed in claim 9, wherein said foam block has cell diameter grater than a particle size of the solid component.

11. An apparatus as claimed in claim 9, further comprising;

two electrodes for forming the electric field therebetween; and two foam blocks respectively mounted on one of said two electrodes for electrodeposting the solid component and the other electrode for not electrodeposting said solid component, said two foam blocks each having a particular cell diameter;

wherein the foam block mounted on said one electrode has a cell diameter smaller than the other foam block mounted on said other electrode.

12. An apparatus as claimed in claim 11, wherein a gap between said two electrodes is sequentially reduced in the direction of migration of the developing liquid.

13. An apparatus as claimed in claim 9, wherein said foam block has a cell diameter sequentially decreasing in the direction of migration of the developing liquid.

14. An apparatus as claimed in claim 9, wherein a plurality of separating means are arranged.

15. An image forming method for forming a toner image on an image carrier with a developing liquid comprising of a liquid and toner dispersed in said liquid, transferring said toner image from said image carrier to a recording medium, and removing said developing liquid left on a surface of said image carrier after image transfer to thereby clean said surface, said image forming method comprising the steps of:

(a) collecting the developing liquid removed from said image carrier;

(b) causing the developing liquid collected to migrate through a member capable of controlling spread of said developing liquid;

(c) causing an electric field to act on the developing liquid migrating through said member; and (d) moving a solid component contained in the developing liquid to a preselected position and retaining said solid component at said preselected position, whereby a liquid component also contained in the developing liquid is recovered via said member.

16. A method as claimed in claim 15, wherein said member comprises a foam block having a tridimensional mesh structure having continuous cells.

17. A method as claimed in claim 15, wherein a plurality of members capable of controlling the spread of the developing liquid are arranged.

18. An image forming method for forming a toner image on an image carrier with a developing liquid comprising of a liquid and toner dispersed in said liquid, transferring said toner image from said image carrier to an intermediate transfer body, transferring said toner image from said intermediate transfer body to a recording medium, and removing said developing liquid left on at least either one of a surface of said image carrier and a surface of said intermediate transfer body after image transfer to thereby effect cleaning, said image forming method comprising the steps of:

(a) collecting the developing liquid removed from at least either one of the surface of said image carrier and the surface of said intermediate transfer body;

(b) causing the developing liquid collected to migrate through a member capable of controlling spread of said developing liquid;

(c) causing an electric field to act on the developing liquid migrating through said member; and (d) moving a solid component contained in the developing liquid to a preselected position and retaining said solid component at said preselected position, whereby a liquid component also contained in the developing liquid is recovered via said member.

19. A method as claimed in claim 18, wherein said member comprises a foam block having a tridimensional mesh structure having continuous cells.

20. A method as claimed in claim 18, wherein a plurality of members capable of controlling the spread of the developing liquid are arranged.

21. An image forming method for forming a toner image on an image carrier with a developing liquid comprising of a liquid and toner dispersed in said liquid, transferring said toner image from said image carrier to an intermediate transfer body, transferring said toner image from said intermediate transfer body to a recording medium, and removing said developing liquid left on a surface of said image carrier and a surface of said intermediate transfer body after image transfer to thereby clean said surfaces, said image forming method comprising the steps of:

(a) collecting the developing liquid removed from the surface of said image carrier and the surface of said intermediate transfer body;

(b) causing the developing liquid collected to migrate through a member capable of controlling spread of said developing liquid;

(c) causing an electric field to act on the developing liquid migrating through said member; and (d) moving a solid component contained in the developing liquid to a preselected position and retaining said solid component at said preselected position, whereby a liquid component also contained in the developing liquid is recovered via said member.

22. A method as claimed in claim 21, wherein said member comprises a foam block having a tridimensional mesh structure having continuous cells.

23. A method as claimed in claim 21, wherein a plurality of members capable of reducing the spread of the developing liquid are arranged.

24. An image forming apparatus using a developing liquid comprising of a liquid and toner dispersed in said liquid, comprising:

a developing means for developing a latent image electrostatically formed on an image carrier by using the developing liquid to thereby form a corresponding toner image;

a transferring means for transferring the toner image from said image carrier to a recording medium;

a cleaning means for collecting the developing liquid left after image transfer for thereby effecting cleaning; and a separating means comprising a member capable of controlling spread of the developing liquid collected by said cleaning means, wherein said developing liquid is caused to migrate through said member under the action of an electric field to thereby move a solid component contained in said developing liquid to a preselected position and retain said solid component at said preselected position, whereby a liquid component also contained in said developing liquid is recovered via said member.

25. An apparatus as claimed in claim 24, wherein said member comprises a foam block having a tridimensional mesh structure having continuous cells.

26. An apparatus as claimed in claim 24, wherein said member has a concave configuration.

27. An apparatus as claimed in claim 24, wherein a plurality of members capable of controlling the spread of the developing liquid are arranged.

28. An apparatus as claimed in claim 24, further comprising two electrodes for forming the electric field therebetween, wherein cells open at side surfaces of said member not contacting said two electrodes are stopped up.

29. An apparatus as claimed in claim 24, wherein a separating device constituted by said separating means is constructed integrally with a cleaning device implemented by said cleaning means.

30. An image forming apparatus using a developing liquid comprising of a liquid and toner dispersed in said liquid, comprising:

an image forming means for forming a toner image on an image carrier with the developing liquid;

a first transferring means for transferring the toner image from said image carrier to an intermediate transfer body;

a second transferring means for transferring the toner image from said intermediate body to a recording medium;

a cleaning means for collecting the developing liquid left on at least either one of a surface of said image carrier and a surface of said intermediate transfer body after image transfer for thereby effecting cleaning; and a separating means comprising a member capable of controlling spread of the developing liquid collected by said cleaning means, wherein said developing liquid is caused to migrate through said member under the action of an electric field to thereby move a solid component contained in said developing liquid to a preselected position and retain said solid component at said preselected position, whereby a liquid component also contained in said developing liquid is recovered via member.

31. An apparatus as claimed in claim 30, wherein said member comprises a foam block having a tridimensional mesh structure having continuous cells.

32. An apparatus as claimed in claim 30, wherein said member has a concave configuration.

33. An apparatus as claimed in claim 30, wherein a plurality of members capable of controlling the spread of the developing liquid are arranged.

34. An apparatus as claimed in claim 30, further comprising two electrodes for forming the electric field therebetween, wherein cells open at side surfaces of said member not contacting said two electrodes are stopped up.

35. An apparatus as claimed in claim 30, wherein a separating device constituted by said separating means is constructed integrally with a cleaning device implemented by said cleaning means.

36. An image forming apparatus using a developing liquid comprising of a liquid and toner dispersed in said liquid, comprising:

an image forming means for forming a toner image on an image carrier with the developing liquid;

a first transferring means for transferring the toner image from said image carrier to an intermediate transfer body;

a second transferring means for transferring the toner image from said intermediate body to a recording medium;

a cleaning means for collecting the developing liquid left on a surface of said image carrier and a surface of said intermediate transfer body after image transfer to thereby clean said surfaces; and a separating means comprising a member capable of reducing spread of the developing liquid collected by said cleaning means, wherein said developing liquid is caused to migrate through said member under the action of an electric field to thereby move a solid component contained in said developing liquid to a preselected position and retain said solid component at said preselected position, whereby a liquid component also contained in said developing liquid is recovered via said member.

37. An apparatus as claimed in claim 36, wherein said member comprises a foam block having a tridimensional mesh structure having continuous cells.

38. An apparatus as claimed in claim 36, wherein said member has a concave configuration.

39. An apparatus as claimed in claim 36, wherein a plurality of members capable of controlling the spread of the developing liquid are arranged.

40. An apparatus as claimed in claim 36, further comprising two electrodes for forming the electric field therebetween, wherein cells open at side surfaces of said member not contacting said two electrodes are stopped up.

41. An apparatus as claimed in claim 36, wherein a separating device constituted by said separating means is constructed integrally with a cleaning device implemented by said cleaning means.

* * * * *